US005311649A

United States Patent [19]

Suh

[11] Patent Number: 5,311,649

[45] Date of Patent: May 17, 1994

[54] FASTENER WITH A FIXING PIECE

[76] Inventor: Sam A. Suh, 2-Dong 901 Daewon Mansion, 245-1 Younsun 4-Dong, Yongdo-ku, Pusan, Rep. of Korea

[21] Appl. No.: 47,301

[22] Filed: Apr. 19, 1993

[30] Foreign Application Priority Data

Jan. 27, 1992 [KR] Rep. of Korea ..... 92-1277

[51] Int. Cl.[5] ..... A44B 11/00

[52] U.S. Cl. ..... 24/625; 24/616; 24/635

[58] Field of Search ..... 24/625, 615, 616, 606, 24/633, 635

[56] References Cited

U.S. PATENT DOCUMENTS 4,679,282 7/1987 Feng ..... 24/615
4,831,694 5/1989 Kong ..... 24/606
4,894,890 11/1990 Kasai ..... 24/625
4,912,950 4/1990 Crowle ..... 24/625
5,113,556 5/1992 Murai et al. ..... 24/615
5,144,259 9/1992 Krauss ..... 24/625

*Primary Examiner*—Victor N. Sakran
*Attorney, Agent, or Firm*—Birch, Stewart, Kolasch & Birch

[57] ABSTRACT

A bag fastener with a fixing piece includes a locking piece insertable into a fastening body, such that the fastener does not unlock in use. When unlocking the fastener from a locked condition, the locking piece is released and unlocked from the fastening body. Accordingly it is possible to use the fastener safely because it is not unlocked in use by natural forces, in contrast with known fasteners which are unlocked in use by natural forces acting on the fastener.

5 Claims, 2 Drawing Sheets

FASTENER WITH A FIXING PIECE

BACKGROUND OF THE INVENTION

1. Field of the Invention

The present invention generally relates to a locking device for a use in a bag for student, a waist sack, a rucksack and the like and more particularly to a bag fastener with a fixing piece having a safety device in order that the bag fastener may not be separated naturally in use.

2. Description of Related Art

Previously, fasteners have been known in which the insert is merely locked or unlocked in the fastening body. However, the prior art fasteners described above include several defects in which the insert is separated from the fastening body due to the excessive weight of the bag while walking or it is easily unlocked even if some force is exerted on the unlocking pusher in a crowded bus and so on. Accordingly, the bay may be opened and its contents will often be inadvertently poured out.

SUMMARY OF THE INVENTION

It is accordingly a primary object of the present invention to provide a bag fastener that overcomes the foregoing problems associated with the prior art.

Another object of the present invention is to prevent the insert from unlocking naturally in use by using a safety device in the fastening body.

The foregoing and other objects as well as advantages of the present invention will become clear by the following description of the invention with reference to the accompanying drawings.

DETAILED DESCRIPTION OF THE PREFERRED EMBODIMENTS

Figure 1:
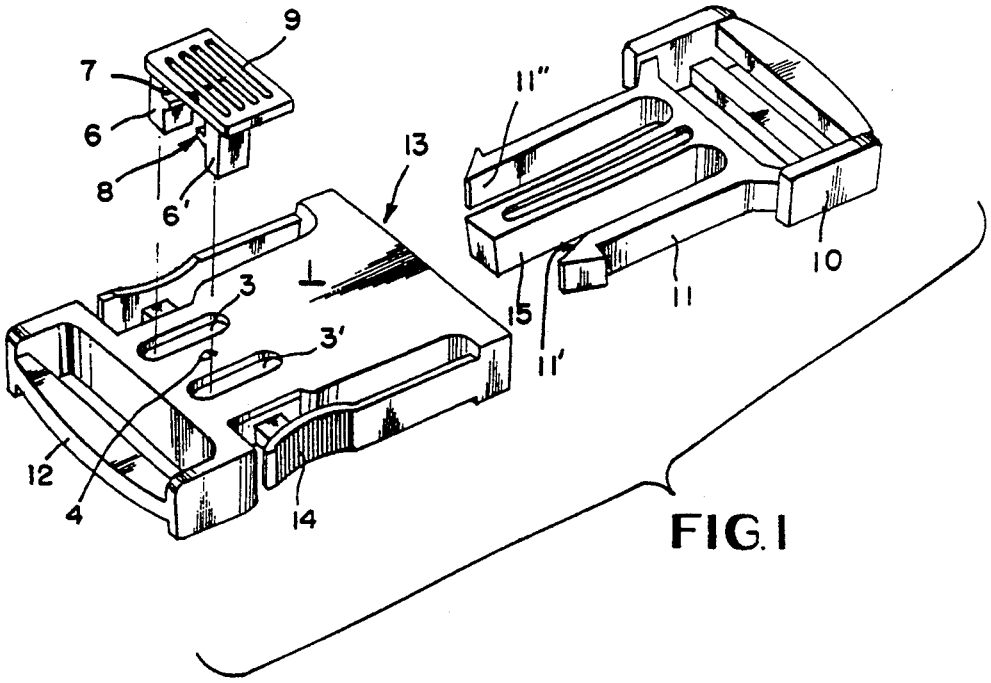
FIG. 1 is an exploded perspective view of the bag fastener according to the present invention.
Figure 2:
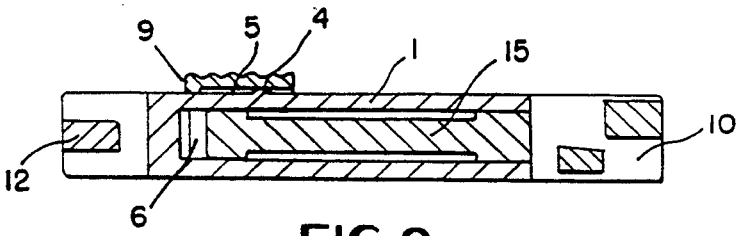
FIG. 2 is a cross-sectional view of the fastener according to the present invention wherein an insert is inserted in the fastening body.
Figure 3:
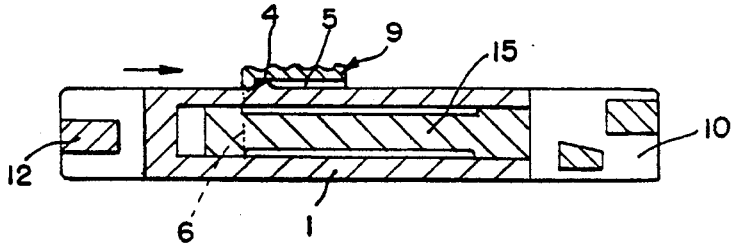
FIG. 3 is a cross-sectional view of the fastener according to the present invention wherein a locking piece is slightly pulled.
Figure 4:
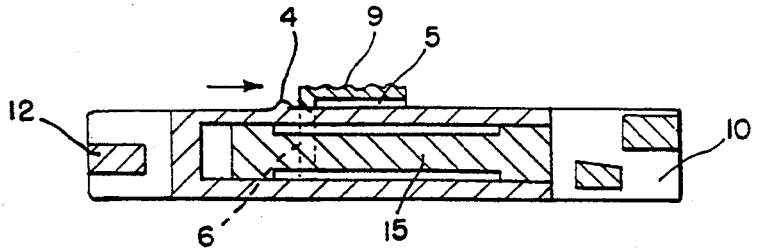
FIG. 4 is a cross-sectional view of the fastener according to the present invention wherein a locking piece is locked.

An embodiment of a fastener with a fixing piece according to the present invention will hereinafter be described with reference to FIGS. 1–7.

The fastener according to the present invention mainly comprises a fastening body 1 and a locking piece 9. Two guide holes 3, 3' are formed at both sides on the top of the fastening body 1 and a fixing projection 5 projects upward from a center of the fastening body 1. A working groove 5 is formed at the bottom of the locking piece 9 and a hanging jaw 7 and a slope 8 are formed at an inside of the top of a pair of fixing legs 6, 6' in a locking piece 9. The locking piece 9 is inserted in the guide holes 3, 3' by mating the pair of fixing legs 6, 6' with the guide holes 3, 3', respectively.

According to the present invention, when an insert 10 is inserted into the fastening body 1, a leg 11 of the insert is somewhat contracted and inserted in the fastening body 1. When the insert is fully inserted in the fastening body 1, the leg 11 of the insert is returned to its original state and locked.

Figure 5A:
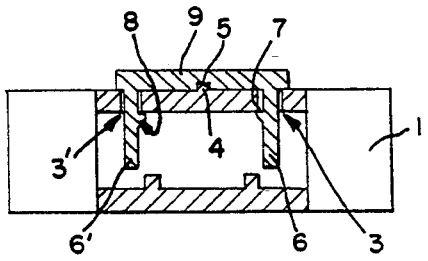
FIG. 5A is a longitudinal sectional view of the fastening body of the fastener seen from an entrance thereof showing a condition before a locking piece is locked.
Figure 5B:
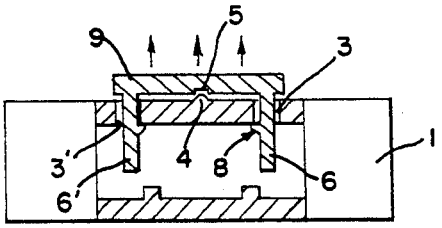
FIG. 5B is a longitudinal sectional view of the fastening body of the fastener seen from the entrance thereof showing a condition in which a locking piece is passed over the fixing projection.

After locking, if the insert 10 is to be safely locked in the fastening body 1, the locking piece 9 pushed toward a hanger 12 is subsequently pushed toward the entrance 13. Then the working groove 5 in the bottom of the locking piece 9 is moved forward along the fixing projection 4 formed in the middle of the top side of the fastening body 1. When the extremity of the working groove 5 of the locking piece 9 reaches the fixing projection 4, if some force is further exerted forward on it, the locking piece 9 is somewhat rised upward as a whole and is lowered again when passing the fixing projection 4, as shown in FIG. 5B. At this time, the fixing legs 6, 6' of the locking piece 9 are moved forward along the guide holes 3, 3' in the top side of the fastening body 1 and are safely seated in both ends 11', 11'' between a central supporter 15 and leg 11 of the insert 10.

Thus, the locking piece 9 is closely fitted toward the insert 10 and fixed without moving because the fixing projection 4 supports the locking piece 9.

In this condition locked by the locking piece 9, the leg 11 of the insert is somewhat contracted inwardly and the inner ends 11', 11'' of the leg (11) are in contact with the fixing legs 6, 6' of the locking piece 9, even if some force is exerted on the insert 10. Accordingly the leg 11 is not contracted any more and not unlocked and so it is locked safely.

Figure 6:
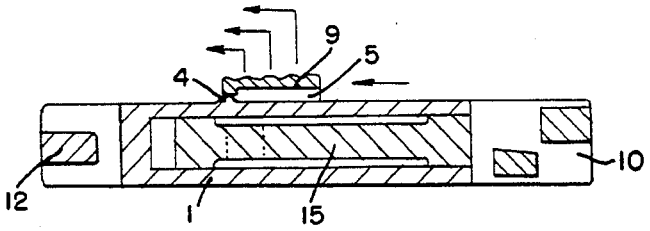
FIG. 6 is a schematic view of the fastening body of the fastener according to the present invention showing a condition in which the locking piece is removed from the fastening body.
Figure 7A:
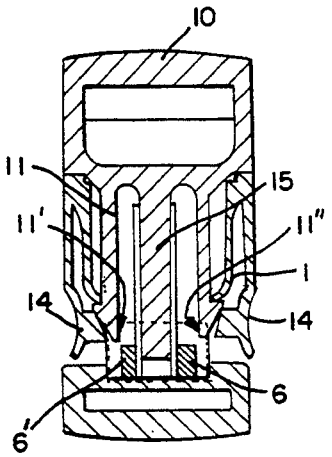
FIG. 7A is a transverse sectional view of the fastening body of the fastener according to the present invention showing the condition before the locking piece is locked.
Figure 7B:
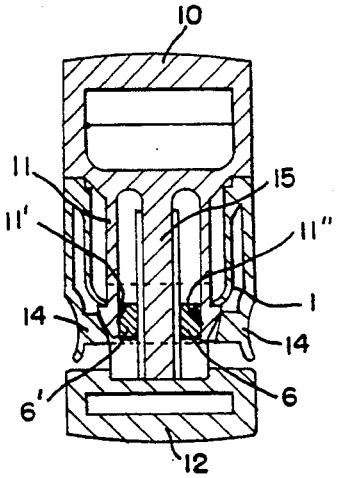
FIG. 7B is a transverse sectional view of the fastening body of the fastener according to the present showing the condition after the locking piece is locked.

When unlocking in the condition locked in this way, the locking piece 9 is somewhat raised upward and advanced beyond the fixing projection 4 as shown in FIG. 6 to its original insertion position. As the fixing projection 4 reaches the working groove 5, the fixing legs 6, 6' of the locking piece 9 are lowered toward the hanger 12 along the guide holes 3, 3'. As the fixing legs 6, 6' of the locking piece 9 are passed between the ends 11', 11'' of the leg 11 and the central supporter 15 of the insert 10 and the locking device is released, the movement of the locking piece 9 is stopped and then a pair of pushing pieces 14 of the fastening body 1 are pressed simultaneously at both sides of the fastening body 1, respectively. Then, the insert 10 is unlocked by an elastic and repelling force.

According to the present invention, in assembling the locking piece 9, it is easily inserted in the guide holes 3, 3' by the lower slope 8 of the fixing legs 6, 6'. Once the locking piece 9 is inserted, it is not detached from the fastening body 1 due to the hanging jaw 7.

Thus, once the locking piece is inserted and locked in the fastening body, the fastener according to the present invention is not unlocked in use if a physical force from the outside is exerted on it. Therefore, it is possible to use the fastener safely.

The above description is given on a single preferred embodiment of the invention, however it will be apparent that modifications and variations could be effected by one skilled in the art without departing from the spirit or scope of the novel concepts of the invention as defined in the appended claim.

What is claimed is:

1. A lockable fastener comprising:

a fastening body;

an insert for mating with said fastening body; and a locking piece slidably and removably engaged with said fastening body, said fastening body including an inlet opening for receiving said insert therein, a pair of longitudinal guide holes formed in an upper surface of said fastening body, a fixing projection upwardly projecting from the upper surface of said fastening body and between the pair of longitudinal guide holes, and a pair of deformable pushing members formed along longitudinal sides of said fastening body and each with a first end fixed adjacent the inlet opening and a second pushing end terminating at a position in lateral correspondence with the pair of longitudinal guide holes and the fixing projection;

said insert including a pair of longitudinally extending leg members, each having toothed ends for engaging with a portion of the fastening body, and a central supporting member extending parallel to and laterally between the leg members; and said locking piece including a pair of fixing legs snap fit into the pair of longitudinal guide holes, respectively, and slidable within a longitudinal length of the guide holes, and an upper gripping surface for manually actuating said locking piece, wherein positioning of said locking piece at ends of the longitudinal guide holes toward the inlet opening of said fastening body wedges the fixing legs between the longitudinally extending leg members and the central supporting member thereby locking said fastener, and wherein position of said locking piece at ends of the longitudinal guide holes away from the inlet opening of said fastening body releases the fixing legs from between the longitudinally extending leg members and the central supporting member thereby unlocking said fastener.

2. The lockable fastener according to claim 1, wherein the fixing projection contacts an under surface of said locking piece to control a longitudinal sliding distance thereof on said fastening body.

3. The lockable fastener according to claim 1, wherein the pair of deformable pushing members include inner projections formed at the second pushing end thereof which fit against the toothed inner ends of the pair of leg members such that squeezing of the pair of deformable pushing members correspondingly squeezes the pair of leg members thereby releasing the toothed inner ends thereof from engagement with said fastening body.

4. The lockable fastener according to claim 1, wherein said locking piece further includes a hanging jaw positioned at an upper end of each fixing leg for gripping an inner longitudinal edge of a longitudinal hole beneath the upper gripping surface, and wherein each fixing leg includes a tapered depending surface to facilitate insertion of the fixing leg into the longitudinal hole.

5. The lockable fastener according to claim 1, wherein said locking piece includes a liftable upper gripping surface for enabling lifting of the locking piece and sliding thereof over the fixing projection until said locking piece is seated on an inlet side of said fixing projection.

* * * * *